US007717763B2

(12) United States Patent
Lei

(10) Patent No.: US 7,717,763 B2
(45) Date of Patent: May 18, 2010

(54) WATER SPORTS BOARD WITH WAVE ENGAGER

(76) Inventor: Skip A. Lei, 2873 SW. Labbe Ave., Portland, OR (US) 97221

( * ) Notice: Subject to any disclaimer, the term of this patent is extended or adjusted under 35 U.S.C. 154(b) by 441 days.

(21) Appl. No.: 11/350,399

(22) Filed: Feb. 7, 2006

(65) Prior Publication Data

US 2007/0051775 A1 Mar. 8, 2007

Related U.S. Application Data

(60) Provisional application No. 60/650,761, filed on Feb. 7, 2005.

(51) Int. Cl.

| | |
|---|---|
| ***A63C 5/03*** | (2006.01) |
| ***B63B 35/81*** | (2006.01) |
| *B63B 1/00* | (2006.01) |
| *B63B 35/00* | (2006.01) |

(52) U.S. Cl. ..... 441/74; 441/65; 441/79

(58) Field of Classification Search ..... 441/65, 441/68, 74, 79; 114/39.12, 39.14

See application file for complete search history.

(56) References Cited

U.S. PATENT DOCUMENTS 850,034 A * 4/1907 Miller ..... 114/57
6,007,393 A * 12/1999 Choiniere et al. ..... 441/74

* cited by examiner

*Primary Examiner*—Daniel V Venne
(74) *Attorney, Agent, or Firm*—Sean Fitzgerald

(57) ABSTRACT

A personal water sports board with a wave engager operably secured thereto for operation in a flow of water, such as a boogie board and the like, is disclosed. The wave engager has a wall shaped to allow water to flow freely thereby in one direction, but to operably engage water flowing from an opposite second direction thereby propelling the board in that opposite second direction. Disclosed embodiments include wave engagers formed of indentions and/or protrusions along the water engaging surface of the board. Preferably, a plurality of wave engagers are provided, and the height of each wave engager's wall increases the further it is positioned toward the front of the board. Wave engagers are preferably positioned on the lower surface and/or on the left and right sides of the board.

13 Claims, 2 Drawing Sheets

WATER SPORTS BOARD WITH WAVE ENGAGER

CROSS REFERENCE TO RELATED APPLICATIONS

This application claims priority to U.S. provisional patent application Ser. No. 60/650,761, filed on Feb. 7, 2005.

FIELD OF THE INVENTION

This invention relates to personal water sports boards such as boogie boards and the like that are usually propelled by traveling with the flow of water in which they are used.

BACKGROUND

Personal water sports boards are floating boards upon which a rider travels on the water. The typical personal water sports board is not self-propelled. Rather, a rider positions themselves on top of the board and usually maneuvers the personal water sports board through a flow of water.

One known type of personal water sports board is commonly referred to as a "boogie board." Riders position themselves face down on top of the boogie board so that their torso rests on the board with their arms and legs extending into the water. While riders of boogie boards routinely use their arms and legs to propel, maneuver and "steer" the board, the primary goal is to position the board in a flow of water, such as a wave along a shoreline or the like, and ride the flow of water while on the board.

Accordingly, it is desirable for the board to easily engage and be driven by this flow of water while still allowing the rider to propel, maneuver and steer the board as needed.

To date, efforts to improve a personal water sports board's operability have had limited success. Some improvements have focused on improving the materials used to form the board. For example, U.S. Pat. No. 5,489,228 to Richardson et al. discloses forming a water sports board with a low density, high strength elongated core surrounded by an outer layer formed of soft resilient non-permeable material. Similarly, U.S. Pat. No. 5,766,051 to Messer discloses mounting a traction pad on top of a wakeboard to improve the engagement between the rider and board.

More recently, some inventors have attempted to modify the overall shape of the board in an effort to improve its operating characteristics. For example, U.S. Pat. No. 6,935,909 to Mann discloses a gliding board having a curved lower surface defining an anticlastic shape to resemble the shape of a saddle.

Despite these improvements, none is directed to improving a personal water sports board's ability to better engage a driving flow of water in which it is being operated.

SUMMARY OF THE INVENTION

The present is a personal water sports board that has a wave engager along a water-engaging surface. The wave engager allows substantially laminar water flow past it in a first direction, but operably engages the flow of water originating from an opposite second direction so as to drive the board in that opposite second direction.

In a disclosed embodiment, the board has a front side and a back side, and the wave engager is positioned so as to operably engage the flow of water traveling from the back side to the front side. Accordingly, when a rider directs the board toward a shoreline, waves will operably engage the wave engager thereby driving the board toward the shoreline without the wave engager substantially interfering with the forward movement of the board through the water. This driving action creates the desirable sensation of the wave "pushing" the board.

Wave engagers are preferably indentations and/or protrusions along a water engaging surface that define a wall. That wall is aligned substantially perpendicular to and positioned in the second flow of water. In one disclosed embodiment, a plurality of wave engagers are operably secured to the water sports board, and they are preferably aligned symmetrically along a longitudinal centerline of the board. In other disclosed embodiments, the wall height of the plurality of wave engagers is graduated so as to increase from back to front, and wave engagers are mounted to the sides of the board.

Other advantages and features of the present invention will become clear upon study of the following portion of this specification and drawings.

DETAILED DESCRIPTION OF PREFERRED EMBODIMENTS

A personal water sports board 10 with at least one wave engager (30*a*-30*f*, 90) operably secured to a water-engaging surface thereof is disclosed in FIGS. 1-8.

Figures 1, 2, 3, 4, 5, 6:
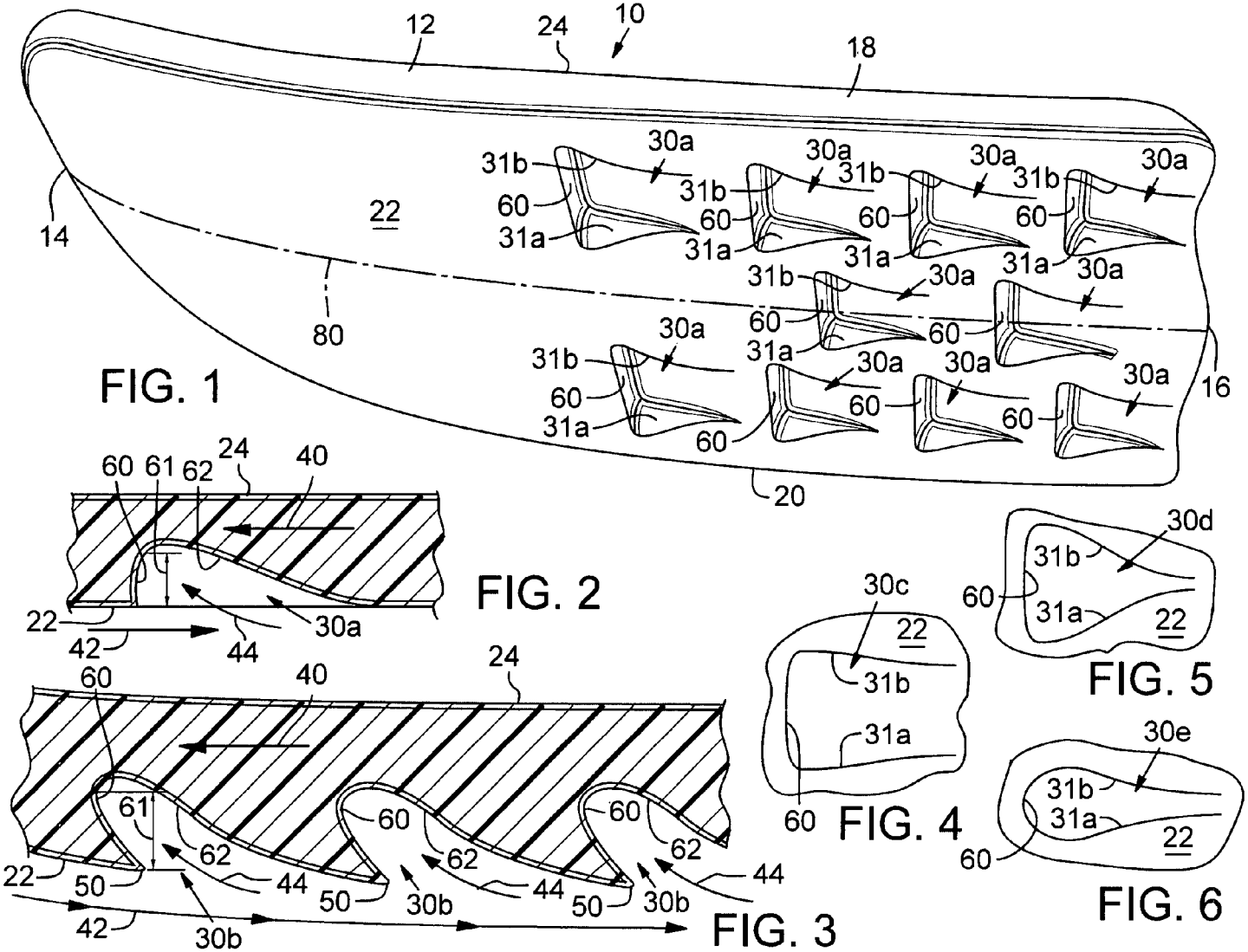
FIG. 1 is a lower, isometric view of a personal water sports board having at least one wave engager thereon in accordance with an embodiment of the present invention.
FIG. 2 is a partial cross-sectional view of the personal water sports board of FIG. 1.
FIG. 3 is an alternative possible cross-sectional view of a personal water sports board showing an exemplar first alternative possible wave engager shape.
FIG. 4 is a partial bottom view of a personal water sports board showing an exemplar second alternative possible wave engager shape.
FIG. 5 is a partial bottom view of a personal water sports board showing an exemplar third alternative possible wave engager shape.
FIG. 6 is a partial bottom view of a personal water sports board showing an exemplar fourth alternative possible wave engager shape.

The personal water sports board 10 is formed of a floatable material and preferably substantially planer with a slightly curved front end portion to define a front end 14, back end 16, left side 18, right side 20, lower surface 22, and upper surface 24. The lower surface 22 is a water engaging surface and is substantially smooth so as to allow water to flow substantially smoothly thereunder in a first direction (shown as arrow 42, FIG. 2)) when the board 10 moves in a forward direction shown as arrow 40 (FIG. 2). Preferably, the board 10 is also symmetrical about a longitudinal centerline 80

Preferably, wave engagers 30*a-f* are positioned along the lower surface 22 so as to operably engage the flow of water from the opposite second direction, shown as arrow 44 (FIG.

2) without substantially interfering with the first flow of water in the first direction, shown as arrow 42 (FIG. 2).

Exemplar wave engager structures offering this property are shown in FIGS. 1-8.

Referring to FIGS. 1 and 2, a first preferred wave engager 30*a* structure is disclosed. In this disclosed embodiment, the wave engagers 30*a* are indentations in the lower surface 22 of the board 10. The indentation are shaped to define a substantially planar front wall 60 having a defined height 61 (FIG. 2), left and right side walls (31*b*, 31*a*, respectively), and an upwardly sloping upper surface 62 (FIG. 2) that extends between the lower surface 22 to the top of the wall 60 as shown.

Preferably, at least a portion of the wall 60 is aligned substantially perpendicular to the longitudinal centerline 80 of the board 10. The wall portion 60 defines a flowing side, wherein water traveling in a first direction 42 (FIG. 2) substantially flows by said wall 60; and, an engaging side, wherein water traveling in an opposite second direction 44 (FIG. 2) engages said substantially perpendicular wall. Accordingly, water flowing in the direction of arrow 44 (FIG. 2), such as when a user has the board 10 pointed toward a shoreline and a wave breaks from behind the board 10, operably engages the wall 60 and thereby urges the board 10 forward in the direction of arrow 40 (FIG. 2).

The lower surface of the wall 60 and the opposite end of the indentation are aligned along the lower surface 22 of the board 10 as shown. Accordingly, water flowing in the direction of arrow 42 (FIG. 2) flows substantially freely past the wall portion 60.

Figure 7:
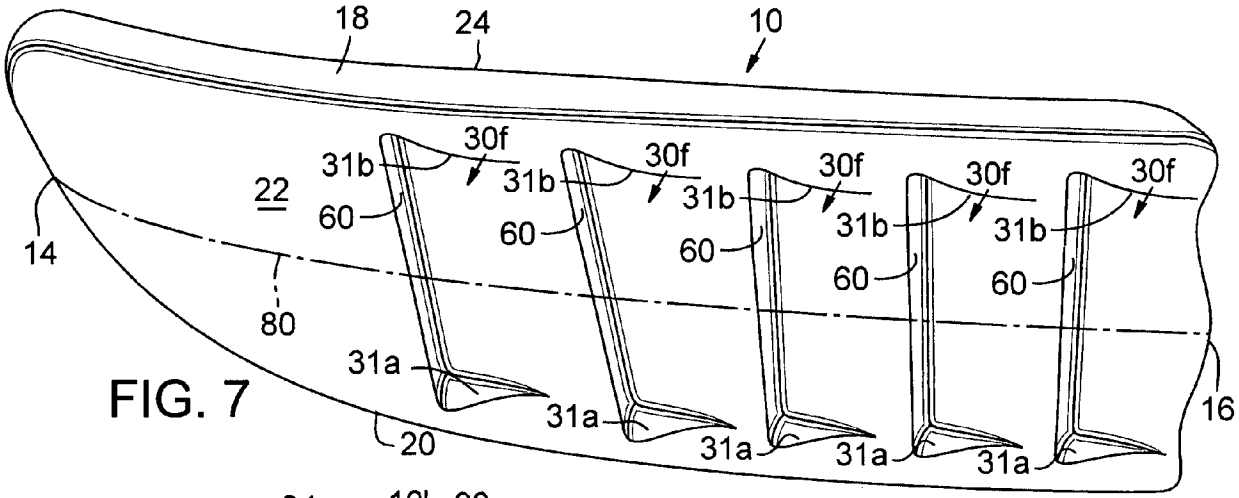
FIG. 7 is a lower, isometric view of the personal water sports board of FIG. 1 showing a fifth alternative possible wave engager shape thereon.
Figure 8:
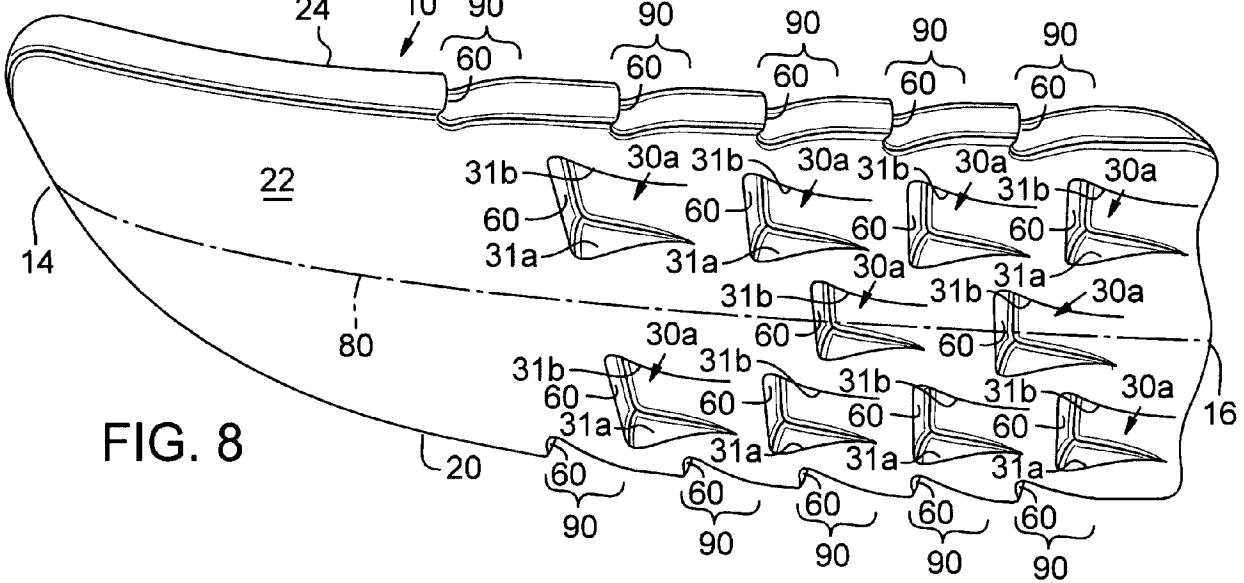
FIG. 8 is a lower, isometric view of the personal water sports board of FIG. 1 with at least one wave engager thereon, and at least one wave engager operably secured to a side of the personal water sports board in accordance with an alternative embodiment of the present invention.

Preferably, a plurality of wave engagers 30*a* are provided on the lower surface 22 of the board, positioned in a symmetrical manner about the longitudinal centerline 80 of the board. As shown in FIGS. 1, 7 and 8, each of the plurality of wave engagers is positioned so as to be independent of any other of said plurality of wave engagers. That is, other than the lower surface 22 itself in which the wave engagers are formed, there are no structures or deformities or indentations in the lower surface 22 formed between the wave engagers to enable the flow of water from one wave engager to another. Water entering a wave engager 30*a* is engaged in one direction to urge the board 10 forward. It is inherent in this structure of the wave engager 30*a* that any water that will exit the wave engager must first exit the wave engager and travel over the lower surface 22 as there are no indentations or structures in lower surface 22 that connect one wave engager to another. This prevents the water held in one wave engager from moving to another wave engager other than over lower surface 22.

More preferably, the defined height of the wave engager walls 60 decreases from the front side 14 to back side 16 of the board. Accordingly, wave engagers 30*a* positioned toward the front side 14 of the board 10 will have higher walls 60 than those positioned toward the back side 16.

Referring to FIG. 3, an alternative possible wave engager 30*b* structure is disclosed. In order to reduce undue repetition like elements between the embodiments have like element numbers. In this second disclosed embodiment, the wave engagers 30*b* are protrusions extending from the lower surface 22 of the board 10 as shown. The protrusions 50 are shaped to define a substantially planar wall 60 having a defined height 61, left and right side walls, and an upwardly sloping upper surface 62 that extends between the lower surface 22 to the top of the wall 60 as shown.

Preferably, at least a portion of the wall 60 is aligned substantially perpendicular to the longitudinal centerline 80 of the board. Accordingly, water flowing in the direction of arrow 44 (FIG. 3), such as when a user has the board 10 pointed toward a shoreline and a wave breaks from behind the board, operably engages the wall 60, thereby urging the board 10 forward in the direction of arrow 40 (FIG. 4). More preferably, instead of the wall 60 being a vertically aligned plane, it is curved to form a substantially c-shaped portion as shown, to enhance engagement of the water flowing in the second direction 44 (FIG. 3).

Preferably, a plurality of wave engagers 30*b* of the second disclosed embodiment are provided on the lower surface 22 of the board, positioned in a symmetrical manner about the longitudinal centerline 80 of the board.

Referring to. FIGS. 4-6, exemplar alternative possible wave engager shapes are disclosed. In FIG. 4, the side walls 31*a*, 31*b* define a substantially rectangular shaped wave engager 30*c*. In FIG. 5, the side walls 31*a*, 31*b* are substantially curved toward each other from the wall 60 to form the wave engager 30*d*. In FIG. 6, the wave engager 30*e* is substantially teardrop shaped.

Referring to FIG. 7, a plurality of wave engagers 30*f*, each extending substantially along the width of the board 10 and straddling the longitudinal centerline 80 of the board, is disclosed. Preferably, the wave engagers 30*f* are aligned so that their respective walls 60 are positioned substantially parallel with each other.

Referring to FIG. 8, a personal water sports board 10' having a plurality of wave engagers 90 mounted on the left and right sides 18, 20 of the board 10' is disclosed. The side mounted wave engagers 90 have no side walls. Rather, they are open at the top and bottom as shown. The walls 60 are aligned substantially vertically and perpendicular to the longitudinal centerline 80 of the board 10'.

Having described preferred embodiments of the present invention; its use is relatively simple. A rider mounts the personal water sports board 10, 10' and positions the board so that the longitudinal centerline 80 is aligned substantially parallel to the flow of water with the front end furthest downstream. In this configuration, the board will move easily forward with the flow of water pushing against the walls of the wave engagers further assisting forward movement of the rider and board. A rider may also propel and maneuver the board using conventional methods such as by lying on the board and using their arms and feet.

Moreover, the wave engagers 30*a-f* can also be used to propel the board. Since the wave engagers 30*a-f* operably engage water in one direction, a user can grasp the left and right sides 18, 20 of the board and move the board forward and backward along the water's surface. The board moves freely forward, but the wave engagers 30*a-f* engage the water when the board is pulled backwards. It can be appreciated that by repeatedly moving the board forward and backwards along its longitudinal centerline 80, the board 10 and its rider will be propelled forward, even in still water.

In view of the wide variety of embodiments to which the principles of the invention can be applied, it should be apparent that the detailed embodiments are illustrative only and should not be taken as limiting the scope of the invention. For example, the size, shape, specific combination, and orientation of wave engagers 30*a-f*, 90 on a board 10, 10' can be adjusted as needed to optimize performance for a particular task. Moreover, the height of the walls 60 can vary between wave engagers on a board. Moreover, the board 10, 10' can include traditional structures such as fins and the like, without compromising the effectiveness of the wave engagers 30*a-f*, 90. Also the disclosed flows of water can also be viewed on a relative basis with respect to the personal water sports board.

Rather, the claimed invention includes all such modifications as may come within the scope of the following claims and equivalents thereto.

What is claimed is:

1. A personal water sports board for operation in a flow of water, said board having an elongate flotation board having a front end, a back end, a longitudinal centerline and a lower surface; and, a plurality of wave engagers formed as indentations in the lower surface, each wave engager of said plurality of wave engagers positioned so as to be independent of, and not connected to any other of said plurality of wave engagers except by the lower surface in which each wave engager is formed, and each wave engager having;

a wall portion positioned substantially perpendicular to the longitudinal centerline of the elongate flotation board;

a flowing side, wherein water traveling in a first direction substantially flows by said wall;

an engaging side, wherein water traveling in an opposite second direction engages said substantially perpendicular wall; and said engaging side positioned so as to engage the flow of water whereby water first entering the wave engager must travel out of the wave engager and over the lower surface before it may enter any other of said plurality of independent wave engagers.

2. The personal water sports board of claim 1, wherein said wave engager further includes left and right side walls.

3. The personal water sports board of claim 2, wherein said left and right side walls extend from said wall portion to define a substantially rectangular shape.

4. The personal water sports board of claim 2, wherein said left and right side walls extend from said wall portion toward each other.

5. The personal water sports board of claim 2, wherein said left and right side walls define a substantially tear-drop shape.

6. The personal water sports board of claim 2, wherein at least one wave engager of said plurality of wave engagers straddles said longitudinal centerline of said board.

7. The personal water sports board of claim 1, wherein said wave engagers forming said plurality of wave engagers are aligned symmetrically about said longitudinal centerline of said board.

8. The personal water sports board of claim 1, wherein the wall portion of each wave engager forming said plurality of wave engagers has a different defined height.

9. The personal water sports board of claim 8, wherein said defined height of each wave engager of said plurality of wave engages increases from the back end to the front end of said board such that wave engages positioned toward the front end of the board have a greater defined height that wave engagers positioned toward the back end of said board.

10. The personal water sports board of clam 1, wherein said wall portion is substantially planar.

11. The personal water sports board of claim 10, wherein at least one wave engager of said plurality of wave engagers is operably secured to said left side, and at least one wave engager of said plurality of wave engagers is operably secured to said right side.

12. The personal water sports board of claim 1, wherein said wall portion is substantially c-shaped.

13. The personal water sports board of claim 1, wherein said personal water sports board is a boogie board and said flow of water is a wave.

* * * * *